United States Patent [19]

Yamada

[11] Patent Number: 4,911,113

[45] Date of Patent: Mar. 27, 1990

[54] VALVE ACTUATING DEVICE FOR MULTIPLE VALVE TYPE ENGINE

[75] Inventor: Tetsuro Yamada, Iwata, Japan

[73] Assignee: Yamaha Hatsudoki Kabushiki Kaisha, Iwata, Japan

[21] Appl. No.: 290,443

[22] Filed: Dec. 27, 1988

[30] Foreign Application Priority Data

Dec. 28, 1987 [JP] Japan ..... 62-329950

[51] Int. Cl.[4] ..... F01L 1/02

[52] U.S. Cl. ..... 123/90.27; 123/193 H; 123/308

[58] Field of Search ..... 123/90.27, 90.22, 90.6, 123/308, 432, 193 H

[56] References Cited

U.S. PATENT DOCUMENTS

| | | | |
|---|---|---|---|
| 4,291,655 | 9/1981 | Yamakawa | 123/193 H |
| 4,319,548 | 3/1982 | Krüger | 123/90.27 |
| 4,378,764 | 4/1983 | Jorgensen | 123/193 H |
| 4,593,657 | 6/1986 | Aoi et al. | 123/90.27 |
| 4,624,222 | 11/1986 | Yoshikawa | 123/90.27 |
| 4,632,073 | 12/1986 | Futakuchi | 123/90.27 |
| 4,637,356 | 1/1987 | Kuroda | 123/90.27 |
| 4,739,735 | 4/1988 | Ichida et al. | 123/193 H |
| 4,754,729 | 7/1988 | Abe et al. | 123/193 H |

FOREIGN PATENT DOCUMENTS

| | | | |
|---|---|---|---|
| 0075643 | 4/1983 | European Pat. Off. | 123/90.27 |
| 0056621 | 4/1982 | Japan | 123/308 |

*Primary Examiner*—Charles J. Myhre
*Assistant Examiner*—Weilun Lo
*Attorney, Agent, or Firm*—Ernest A. Beutler

[57] ABSTRACT

A valve actuating arrangement for a multiple valve engine wherein the valves are positioned so that they have their heads lying at different distances from the axis of rotation of the actuating camshaft. The valve stems are kept at the same length by employing cam lobes for actuating those that have different base circles.

13 Claims, 2 Drawing Sheets

VALVE ACTUATING DEVICE FOR MULTIPLE VALVE TYPE ENGINE

BACKGROUND OF THE INVENTION

This invention relates to a valve actuating device for multiple valve type engines and more particularly to an improved valve operating arrangement for such engines.

It is generally acknowledged that the performance of an internal combustion engine can be improved significantly by utilizing multiple valves. The use of multiple valves for either or both of the intake and/or exhaust function has been found to permit a greater flow area with reduced reciprocating masses. For this reason, it is the common practice for many engines now to use four valves per cylinder (two intake and two exhaust). Even greater advantages can be enjoyed if more than four valves per cylinder are utilized. However, as the number of valves in the cylinder increases, there are other problems that arise which can reduce the power output of the engine. Specifically, as a greater number of valves are used, the configuration of the combustion chamber becomes more difficult to design. Specifically, as greater numbers of valves are employed, the combustion chamber surface area tends to increase and the compression volume also increases. These increases in surface area and compression volume can significantly reduce the power gains achieved by multiple valve engines.

An arrangement has been proposed wherein the use of multiple valves can be enjoyed without the aforenoted defects as to increased combustion chamber volume and surface areas. An arrangement as shown in U.S. Letters Pat. No. 4,624,222, entitled "Intake Valve Structure for Internal Combustion Engine", issued Nov. 25, 1986, and assigned to the assignee of this invention, employs at least three intake valves for a given combustion chamber without adversely affecting the combustion chamber volume or surface area. This is achieved by employing a different angle between the valves and the cylinder bore axis and also by shortening the length of some of the valves relative to other of the valves so as to permit these results. Although this arrangement has the advantages as aforenoted, it results in engines having different length valves serving the same purpose. This gives rise to certain problems in connection with stocking parts, assembly and servicing and reassembly. Furthermore, the use of longer valve stems increases the inertia of the reciprocating masses and this is, obviously, undesirable.

It is, therefore, a principal object of this invention to provide an improved valve actuating device for multiple valve type engines.

It is a further object of this invention to provide a valve arrangement for a multiple valve engine that permits the use of valves having different angles to the combustion chamber yet permits them to be operated by the same camshaft and have the same length.

SUMMARY OF THE INVENTION

This invention is adapted to be embodied in a valve arrangement for an internal combustion engine that is comprised of a cylinder head that defines a combustion chamber. First and second poppet valves having respective stem parts are supported for reciprocation relative to the cylinder head and have respective head portions for controlling the flow between a port and the same combustion chamber. A camshaft is supported for rotation about an axis relative to the cylinder head and the valve head of the first valve lies closer to the camshaft axis than the valve head of the second valve when both of the valves are closed. Means are provided for operating both of the valves from the same camshaft and for permitting the valve stems to have the same length.

DETAILED DESCRIPTION OF THE PREFERRED EMBODIMENT

Figure 1:
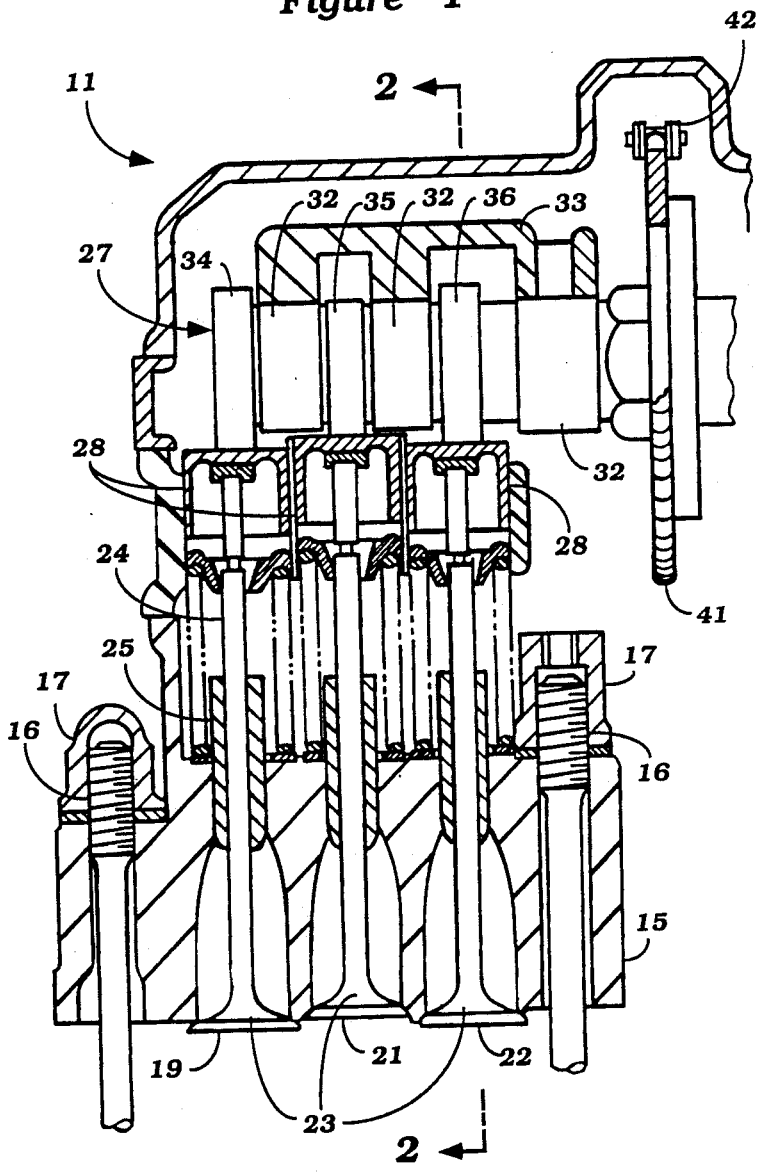
FIG. 1 is a partial cross-sectional view taken through a part of an internal combustion engine constructed in accordance with an embodiment of the invention.
Figure 2:
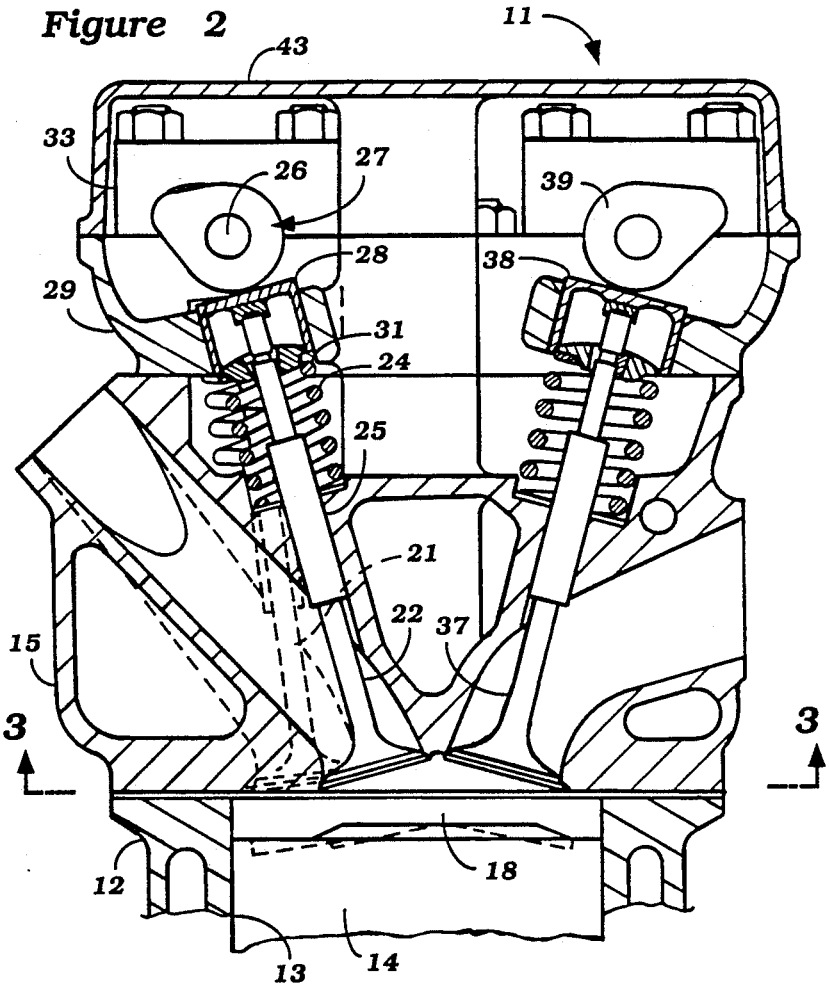
FIG. 2 is a cross-sectional view taken along the line 2—2 of FIG. 1.
Figure 3:
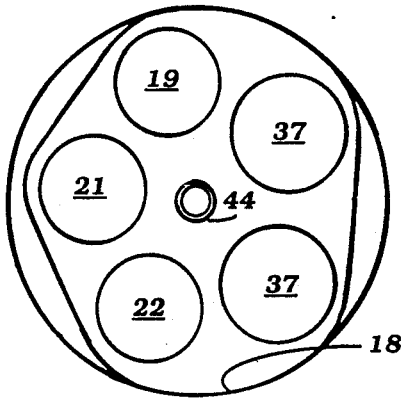
FIG. 3 is a bottom plan view of the combustion chamber formed in the cylinder head and is taken along the line 3—3 of FIG. 2.

In the drawings, the reference numeral 11 indicates generally an internal combustion engine constructed in accordance with an embodiment of the invention. Since the invention is directed primarily to the combustion chamber configuration and valve operating mechanism for it, only this portion of the engine has been depicted. For this reason, it is not necessary to show more than a single cylinder of the engine nor the components other than those which will be described. It should be understood by those skilled in the art how the invention can be practiced with multiple cylinder engines and the construction of the portion of the engine which is not illustrated.

The engine 11 is comprised basically of a cylinder block 12 in which one or more cylinder bores 13 are formed. Pistons 14 are slidably supported in each of the cylinder bores 13 and are connected in a known manner to a crankshaft (not shown) for driving the crankshaft.

A cylinder head, indicated generally by the reference numeral 15, is affixed to the cylinder block 12 in a known manner, as by studs 16 and threaded fasteners 17. The cylinder head 15 is formed with a recess 18 which forms, with the head of the piston 14 and the cylinder bore 13, the combustion chamber. The recess 18 will be described herein as the "combustion chamber" since it forms a substantial portion of the combustion chamber volume at top dead center position of the piston 14.

An induction system is provided for admitting either a fuel/air charge or an air charge to the combustion chamber 18 depending upon whether or not direct cylinder injection is employed. The induction system includes three intake valves 19, 21 and 22 that are disposed on generally one side of a plane containing the axis of the cylinder bore 13. The intake valves 19, 21 and 22 each have respective head portions 23 that cooperate with valve seats that are formed in the cylinder head 16 and which are formed at the termination of respective intake ports. The configuration of the intake ports may be of any known type. For example, there may be a separate intake port for each intake valve 19, 21 and 22 or the valve ports may be siamesed in any known manner.

The intake valves 19, 21 and 22 have respective valve stems 24 that are supported for reciprocating movement in the cylinder head 15 by means of valve guides 25. As is described in aforenoted U.S. Letters Pat. No.

4,624,222, in order to provide a relatively compact combustion chamber 18, the valves 19 and 22 have their stems 24 reciprocating about a line of action that is at a substantially greater angle to the axis of the cylinder bore 13 than the stem 24 of the remaining intake valve 21. Also, the valve stems are disposed so that the valve seat associated with the valves 19 and 22 is disposed lower toward the combustion chamber from the camshaft than the valve seat associated with the valve 21. With previously proposed arrangements, this has meant that the valves 19 and 22 must have longer stems than the valve 21. The disadvantages of this construction have already been noted. As will be described, an arrangement has been provided so as to insure that all of the valves 19, 21 and 22 can have the same length.

As noted in the aforenoted patent, the stems of the valves 19, 21 and 22 all intersect at a common point which coincides with the axis of rotation 26 of an intake camshaft 27. The intake camshaft 27 has lobes, as will be described, that operate thimble tappets 28 that are slidably supported in a cam tower 29 that is affixed to the cylinder head for operating the valves 19, 21 and 22. The valves 19, 21 and 22 are urged toward their close depositions by coil return springs 31 in a known manner.

The camshaft 27 has spaced plain bearing surfaces 32 that are engaged by a bearing cap 33 and cooperating cylinder head bearing surfaces so as to rotatably journal the camshaft 27 about the axis 26 relative to the cylinder head 15. In accordance with the invention, individual cam lobes 34, 35 and 36 are associated with the thimble tappets 28 of the respective valves 19, 21 and 22. In order to permit the valve stems 24 of the valves 19, 21 and 22 to have all of the same length, the base circle or heel of the cam lobes 34 and 36 is substantially greater than the corresponding dimension of the cam lobe 35. As a result, when the valves 19, 21 and 22 are in their closed position, it will be possible to maintain the same lengths for each of the valve stems even though the distance between their valve seats and the camshaft is different. Of course the lift of the individual cams may be the same by appropriately shaping the individual cam lobes 34, 35 and 36. Of course, if desired, different degress of lift can be employed. It is important with the invention, however, that the valve stems be kept at the same length and this can be done, in the illustrated embodiment, by having the heel or base portion of the cam lobes 34 and 36 substantially greater in radius than that of the cam lobe 35. This difference in radius is the same as the difference in distance between the valve seats or valve heads 19 and 23 of the individual valves and the axis of rotation of the camshaft 26.

The engine also has a pair of exhaust valves 37 that are supported on the opposite side of the cylinder head in a generally similar manner. However, the exhaust valves 37 may lie at the same angle to each other. The exhaust valves 37 are operated by thimble tappets 38 that are supported in the cam tower 29 and operated by an exhaust camshaft 39. Sprockets 41 are formed on the individual camshafts 27 and 39 and are driven by a chain 42 in a known manner. A cam cover 43 is affixed to the cam tower 29 and thus completes the cylinder head arrangement.

A spark plug 44 is mounted in the cylinder head 15 in a known manner centrally of the combustion chamber 18 for firing the charge in a known manner.

It should be readily apparent from the foregoing description that the described construction permits the desired valve placement and a compact combustion chamber and still permits the use of valves that have the same length stems. Although the invention has been described in conjunction with an engine having three intake valves and two exhaust valves, it is adaptable to engines having any number of valves. Various other changes and modifications may be made without departing from the spirit and scope of the invention, as defined by the appended claims.

I claim:

1. A valve arrangement for an internal combustion engine comprised of a cylinder head defining a combustion chamber, a first poppet valve having a stem portion supported for reciprocation relative to said cylinder head and having a head portion lying substantially on one side of a plane passing through the center of said combustion chamber for controlling the flow between a port and said combustion chamber, a second poppet valve having a stem portion supported for reciprocation relative to said cylinder head and a head portion lying substantially on said one side of said plane for controlling the flow between a port and said combustion chamber, a camshaft supported for rotation about an axis relative to said cylinder head on said one side of said plane, the valve head of said second valve lying closer to said camshaft axis than the valve head of said first valve to said camshaft axis when both of said valves are closed, and means for operating both of said valves from said camshaft and for permitting said valve stems to have the same length.

2. A valve arrangement as set forth in claim 1 wherein the valves reciprocate about lines of action having different angles to the plane.

3. A valve arrangement for an internal combustion engine comprised of a cylinder bore, a piston in said cylinder bore and a cylinder head defining a combustion chamber, a first poppet valve having a stem portion supported for reciprocation relative to said cylinder head and having a head portion for controlling the flow between a port and said combustion chamber, a second poppet valve having a stem portion supported for reciprocation relative to said cylinder head and a head portion for controlling the flow between a port and said combustion chamber, said valves reciprocating about lines of action having different angles to the axis of said cylinder bore, a camshaft supported for rotation about an axis relative to said cylinder head, the valve head of said second valve lying closer to said camshaft axis than the valve head of said first valve to said camshaft axis when both of said valves are closed, and means for operating both of said valves from said camshaft and for permitting said valve stems to have the same length, the valve having the greatest distance between its head and said camshaft axis lying at a substantially greater angle to said cylinder bore axis that the other valve.

4. A valve arrangement as set forth in claim 3 wherein the means for operating the valves from the camshaft and permitting the valve stems to have the same length comprises individual cam lobes for operating each of the valves with the cam lobes having different radii base circles.

5. A valve arrangement as set forth in claim 1 further including a third poppet valve having a head portion lying substantially on the one side of the plane for controlling the flow between a portion and the combustion chamber and a stem portion slidably supported by the cylinder head, the heads of the first and third valves lying the same distance from the camshaft axis and greater than the distance between the valve head of the second valve and the camshaft axis.

6. A valve arrangement as set forth in claim 5 wherein the first and third valves lie at a substantially greater angle to the plane than the second valve.

7. A valve arrangement as set forth in claim 6 wherein the means for operating the valves from the camshaft and permitting the valve stems to have the same length comprises individual cam lobes for operating each of the valves with the cam lobes having different radii base circles.

8. A valve arrangement as set forth in claim 3 further including a third poppet valve having a head portion for controlling the flow between a portion and the combustion chamber and a stem portion slidably supported by the cylinder head, the heads of the first and third valves lying the same distance from the camshaft axis and greater than the distance between the valve head of the second valve and the camshaft axis.

9. A valve arrangement for an internal combustion engine comprised of a cylinder head defining a combustion chamber, a first poppet valve having a stem portion supported for reciprocation relative to said cylinder head and having a head portion for controlling the flow between a port and said combustion chamber, a second poppet valve having a stem portion supported for reciprocation relative to said cylinder head and a head portion for controlling the flow between a port and said combustion chamber, the lines of reciprocation lying in planes that intersect along a line, a camshaft supported for rotation about an axis relative to said cylinder head, the valve head of said second valve lying closer to said line than the valve head of said first valve to said line when both of said valves are closed, and means for operating both of said valves from said camshaft and for permitting said valve stems to have the same length.

10. A valve arrangement as set forth in claim 9 wherein the means for operating the valves from the camshaft and permitting the valve stems to have the same length comprises individual cam lobes for operating each of the valves with the cam lobes having different radii base circles.

11. A valve arrangement as set forth in claim 9 further including a third poppet valve having a head portion for controlling the flow between a portion and the combustion chamber and a stem portion slidably supported by the cylinder head for reciprocating about a line of action parallel to the line of action of said first valve, the heads of the first and third valves lying the same distance from the line and greater than the distance between the valve had of the second valve and the camshaft axis.

12. A valve arrangement as set forth in claim 11 wherein the first and third valves lie at a substantially greater angle to the cylinder bore axis than the second valve.

13. A valve arrangement as set forth in claim 12 wherein the means for operating the valves from the camshaft and permitting the valve stems to have the same length comprises individual cam lobes for operating each of the valves with the cam lobes having differen radii base circles.

* * * * *